US011234492B2

(12) United States Patent
Kilgore

(10) Patent No.: US 11,234,492 B2
(45) **Date of Patent: *Feb. 1, 2022**

(54) FOOTWEAR MANUFACTURING WITH A NESTED FLAT PATTERN UPPER

(71) Applicant: NIKE, Inc., Beaverton, OR (US)

(72) Inventor: Bruce J. Kilgore, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 230 days.

This patent is subject to a terminal disclaimer.

(21) Appl. No.: 16/531,473

(22) Filed: Aug. 5, 2019

(65) Prior Publication Data

US 2019/0350316 A1 Nov. 21, 2019

Related U.S. Application Data

(63) Continuation of application No. 15/608,821, filed on May 30, 2017, now Pat. No. 10,368,614.

(Continued)

(51) Int. Cl.

| | |
|---|---|
| ***A43D 8/02*** | (2006.01) |
| ***A43D 11/12*** | (2006.01) |
| ***A43D 8/10*** | (2006.01) |
| ***A43D 8/26*** | (2006.01) |
| ***A43D 8/28*** | (2006.01) |

(Continued)

(52) U.S. Cl.

CPC ..... *A43D 11/12* (2013.01); *A43B 23/0245* (2013.01); *A43B 23/042* (2013.01); *A43D 8/02* (2013.01); *A43D 8/10* (2013.01); *A43D 8/26* (2013.01); *A43D 8/28* (2013.01); *A43D 8/30* (2013.01); *A43B 23/0205* (2013.01);

(Continued)

(58) Field of Classification Search

CPC ... A43D 8/00; A43D 8/02; A43D 8/04; A43D 8/06; A43D 8/10; A43D 8/12; A43D 8/26; A43D 8/28; A43D 8/30; A43D 8/38; A43B 23/04; A43B 23/042; A43B 23/0245

See application file for complete search history.

(56) References Cited

U.S. PATENT DOCUMENTS

| | | | |
|---|---|---|---|
| 336,913 | A | 3/1886 | Geaff |
| 1,956,969 | A | 5/1934 | Ayers |

(Continued)

FOREIGN PATENT DOCUMENTS

| | | | |
|---|---|---|---|
| AT | 341373 | B | 2/1978 |
| CA | 2000090 | A | 4/1990 |

(Continued)

*Primary Examiner* — Ted Kavanaugh

(74) *Attorney, Agent, or Firm* — Shook, Hardy & Bacon L.L.P.

(57) ABSTRACT

An article of footwear flat pattern upper having an upper portion and a footbed portion is provided. The upper portion and the footbed portion are integrally continuous, such that the upper portion lateral side converges with the footbed lateral side. The flat pattern includes nested same-sided article of footwear with a reduced surplus portion there between. The articles of footwear include the following continuous portions: the first medial side with a toe end, the toe end with a lateral side, the lateral side with a heel end, and the heel end with the second medial side. The first medial side and the second medial side are joined to form a dimensional article of footwear.

20 Claims, 14 Drawing Sheets

Related U.S. Application Data

(60) Provisional application No. 62/344,365, filed on Jun. 1, 2016.

(51) Int. Cl.
*A43D 8/30* (2006.01)
*A43B 23/02* (2006.01)
*A43B 23/04* (2006.01)

(52) U.S. Cl.
CPC ..... *A43D 2200/10* (2013.01); *A43D 2200/40* (2013.01); *A43D 2200/60* (2013.01)

(56) References Cited

U.S. PATENT DOCUMENTS

| | | | | |
|---|---|---|---|---|
| 2,025,022 | A | 12/1935 | Sussman | |
| 2,471,366 | A | 5/1949 | Cassano | |
| 3,665,793 | A | 5/1972 | Lehner | |
| 3,813,719 | A | 6/1974 | Kaschura | |
| 5,345,638 | A | 9/1994 | Nishida | |
| 10,368,614 | B2 * | 8/2019 | Kilgore ..... | A43B 23/0245 |
| 2014/0202034 | A1 | 7/2014 | VanAtta | |
| 2015/0101133 | A1 | 4/2015 | Manz et al. | |

FOREIGN PATENT DOCUMENTS

| | | | |
|---|---|---|---|
| CN | 102469841 | A | 5/2012 |
| CN | 104574198 | A | 4/2015 |
| CN | 205125236 | U | 4/2016 |
| FR | 680559 | A | 5/1930 |
| FR | 2853819 | A1 | 10/2004 |
| TW | 185986 | | 6/1992 |
| TW | 201524392 | A | 7/2015 |

* cited by examiner

FOOTWEAR MANUFACTURING WITH A NESTED FLAT PATTERN UPPER

CROSS-REFERENCE TO RELATED APPLICATION

This application is a continuation application of U.S. application Ser. No. 15/608,821, filed May 30, 2017, and entitled "Footwear Manufacturing With A Nested Flat Pattern Upper," which claims the benefit of priority to U.S. Provisional Application No. 62/344,365, filed Jun. 1, 2016, and entitled "Footwear Manufacturing With A Nested Flat Pattern Upper." The entirety of the aforementioned applications are incorporated by reference herein.

FIELD

Continuous in-line manufacturing of an article of footwear from a flat pattern.

BACKGROUND

Manufacturing of footwear has traditionally be a laborious process that involves cutting individual pieces and sewing the pieces together to form the footwear. However, this manufacturing process is batch-like in that a series of operations may be performed on a portion of the shoe by a first operator and then another series of operations, later in time, may be performed by a different operator. This start and stop process can lead to inefficiencies in the process.

SUMMARY

Aspects hereof relate to the continuous in-line manufacturing of articles of footwear.

A first aspect relates to a footwear flat pattern comprising a first article of footwear pattern, a second article of footwear pattern, and a surplus portion. The first article of footwear pattern comprises a first upper portion having a toe end and an opposite heel end, a lateral side, a first medial side portion and a second medial side portion, wherein the first medial side portion extends from the toe end and the second medial side portion extends from the heel end. The second article of footwear pattern comprises a second upper portion having a toe end and an opposite heel end, a lateral side, a first medial side portion and a second medial side portion, wherein the first medial side portion extends from the toe end and the second medial side portion extends from the heel end. The surplus portion extends between the first upper portion and the second upper portion. The first article of footwear pattern, the second article of footwear pattern and the surplus portion are integrally continuous.

A second aspect relates to a method of forming an article of footwear from a footwear flat pattern. The method comprises generating a position identifier on a planar substrate. The method includes applying an overlay to the substrate such that the overlay is positioned based, at least in part, on the position identifier on the substrate. The method continues with securing the overlay to the substrate and then removing the article of footwear from the footwear flat pattern. The method includes joining a first edge of the article of footwear first medial side with a second edge of the article of footwear second medial side such that the first edge and second edge form a seam extending from a throat of the article of footwear toward a footbed of the article of footwear. The article of footwear has at least the following integrally continuous portions: the first medial side with a toe end, the toe end with a lateral side, the lateral side with a heel end, and the heel end with the second medial side.

A third aspect relates to an article of footwear comprising an upper portion having a toe end and an opposite heel end, a lateral side, a first medial side portion and a second medial side portion. The upper portion has the following integrally continuous portions: the first medial side with the toe end, the toe end with the lateral side, the lateral side with the heel end, and the heel end with the second medial side. The article of footwear is further comprised of a footbed portion having a toe end and an opposite heel end, a medial side and an opposite lateral side. The upper portion and the footbed portion are integrally continuous (e.g. continues without interruption, breakage, or other post-processing connection) such that the upper portion lateral side converges with the footbed lateral side. The article of footwear is further comprised of a seam extending between the first medial side and the second medial side and extending from a throat of the article of footwear toward a bottom edge to be joined with the footbed portion. The footbed portion is coupled with the first medial side and the second medial side.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative aspects of the present invention are described in detail below with reference to the attached drawing figures, which are incorporated by reference herein and wherein.

DETAILED DESCRIPTION

Figure 1:
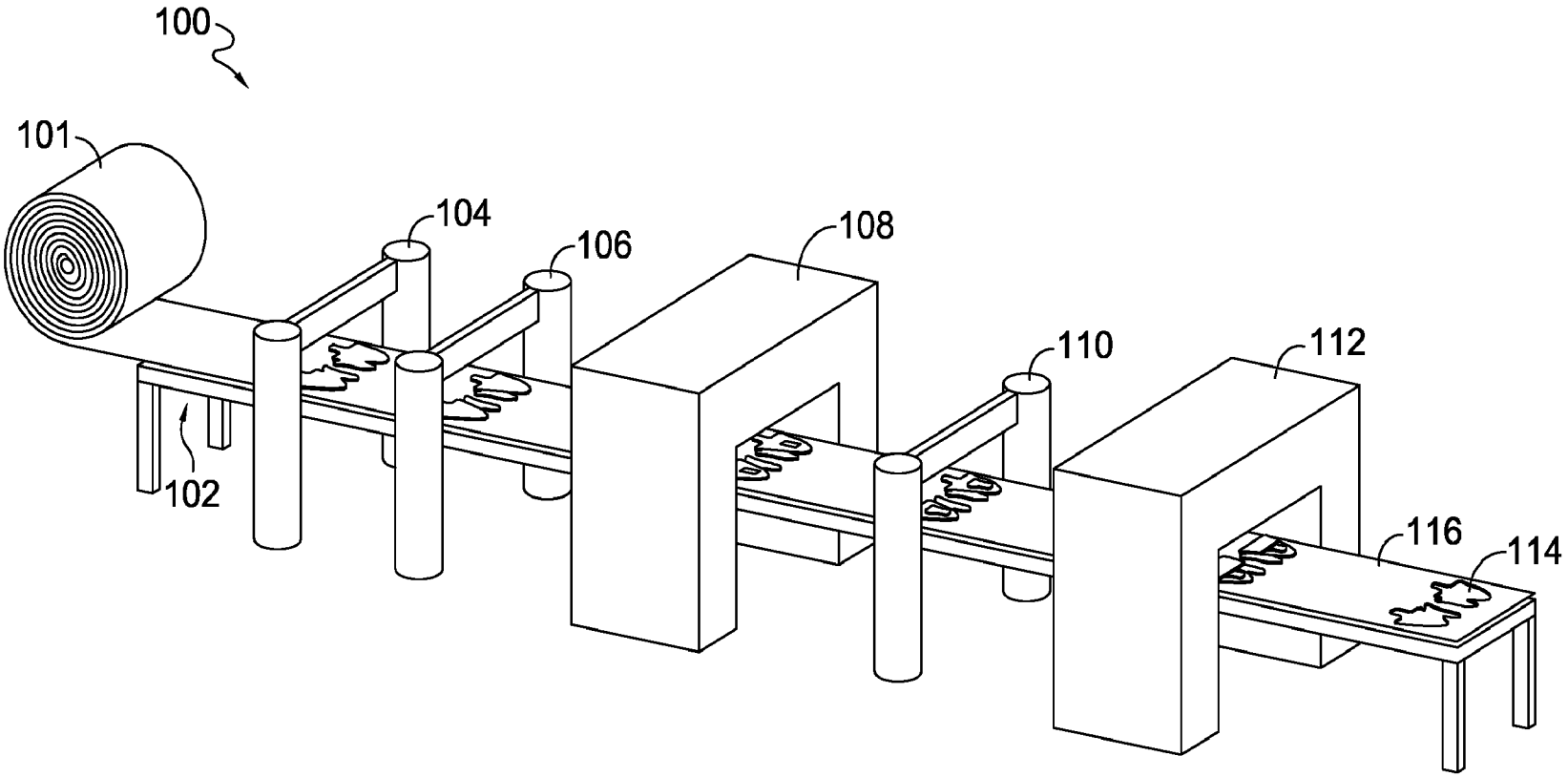
FIG. 1 depicts a continuous in-line production of an article of footwear on a substrate along a series of manufacturing processing stations forming the continuous in-line manufacturing system for a shoe upper, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Aspects hereof relate to the continuous in-line manufacturing of articles of footwear.

A first aspect relates to a footwear flat pattern comprising a first article of footwear pattern, a second article of footwear pattern, and a surplus portion. The first article of footwear pattern comprises a first upper portion having a toe end and an opposite heel end, a lateral side, a first medial side portion and a second medial side portion, wherein the first medial side portion extends from the toe end and the second medial side portion extends from the heel end. The second article of footwear pattern comprises a second upper portion having a toe end and an opposite heel end, a lateral side, a first medial side portion and a second medial side portion, wherein the first medial side portion extends from the toe end and the second medial side portion extends from the heel end. The surplus portion extends between the first upper portion and the second upper portion. The first article of footwear pattern, the second article of footwear pattern and the surplus portion are integrally continuous.

A second aspect relates to a method of forming an article of footwear from a footwear flat pattern. The method comprises generating a position identifier on a planar substrate. The method includes applying an overlay to the substrate such that the overlay is positioned based, at least in part, on the position identifier on the substrate. The method continues with securing the overlay to the substrate and then removing the article of footwear from the footwear flat pattern. The method includes joining a first edge of the article of footwear first medial side with a second edge of the article of footwear second medial side such that the first edge and second edge form a seam extending from a throat of the article of footwear toward a footbed of the article of footwear. The article of footwear has at least the following integrally continuous portions: the first medial side with a toe end, the toe end with a lateral side, the lateral side with a heel end, and the heel end with the second medial side.

A third aspect relates to an article of footwear comprising an upper portion having a toe end and an opposite heel end, a lateral side, a first medial side portion and a second medial side portion. The upper portion has the following integrally continuous portions: the first medial side with the toe end, the toe end with the lateral side, the lateral side with the heel end, and the heel end with the second medial side. The article of footwear is further comprised of a footbed portion having a toe end and an opposite heel end, a medial side and an opposite lateral side. The upper portion and the footbed portion are integrally continuous such that the upper portion lateral side converges with the footbed lateral side. The article of footwear is further comprised of a seam extending between the first medial side and the second medial side and extending from a throat of the article of footwear toward a bottom edge to be joined with the footbed portion. The footbed portion is coupled with the first medial side and the second medial side.

Articles of footwear may include shoes, boots, sandals, and the like. The term "shoe" will be used herein to generically reference an article of footwear. It is understood that the term "shoe" is not limited to a traditional style of a shoe, but instead may include a boot, athletic shoe, sandal, running shoe, cleat, and other articles of footwear. Generally, a shoe is comprised of a ground-contacting portion, which may be referred to as a sole. The sole may be formed from a variety of materials and/or a variety of individual components. For example, a sole may comprise an outsole, a midsole, and/or and insole, as is known in the art. The shoe may also be comprised of a foot-securing portion that is effective to secure a user's foot to the sole. The foot-securing portion may be referred to as a shoe upper, or "upper" for short herein. An upper may be formed from one or more materials and/or one or more individual components. An exemplary system and technique for forming an upper is provided hereinafter in greater detail.

Regardless of the materials or techniques for forming the upper and/or sole, additional shaping and forming may be used to obtain a desired three-dimensional shape (e.g., a dimensional shoe). Traditionally, a tooling known as a cobbler's last serves as a shape about which a shoe may be formed to a desired size, shape, and construction. As used herein, the term "last" will reference a tool form about which an upper may be formed. In some aspects, a sole may be coupled (e.g., adhered, stitched) to the upper as the upper is lasted (i.e., having the last positioned in an interior volume of the upper). The last may define the contours, shape, style, and other characteristics of a resulting shoe.

Aspects herein contemplate a flat pattern that is then formed into a dimensional shoe. A "flat pattern" is a substantially planar collection of materials as generally depicted in FIGS. 2-9. While the different materials may be coupled to one another in a manner that form textures, bumps, embossing, protrusions, and the like, the collection of materials is still substantially planar and therefore, "flat" even with the deviations in height along a surface. The flat pattern, when formed about a last to create a receiving cavity in which a user's foot may be secured, becomes a "dimensional" article. For example, a three-dimensional article of footwear is an article that is formed in a manner that can be secured to and around a portion of a wearer. A "flat" pattern, in contrast to a "dimensional" article, is not formed to be received about a portion of a wearer, in an exemplary aspect. The concept of a flat pattern is conducive to manufacturing as many materials used to form a shoe upper are rolled goods that are in a substantially planar (e.g., sheet-like) configuration in their raw state. Therefore, construction of a shoe upper from a collection of flat components may be automated for a continuous in-line manufacturing process as a flat pattern that is later converted into a dimensional article, such as through the use of a last or bespoke tooling. A flat pattern is a material or collection of materials that form a planar shape that when processed dimensionally, join to form the dimensional version of the article. The general concept of a "pattern" is traditionally used in cut-and-sew industries, such as a dress-making pattern and the like.

At a high level, aspects contemplate forming a shoe upper in a continuous in-line manufacturing process that allows for varied style, size, and/or materials for each of the shoe upper portions formed as part of the in-line manufacturing. It is contemplated that the manufacturing may be automated such that one or more processes along the continuous line are performed by machines that are programmed to complete a specific series of tasks. Additionally or alternatively, it is contemplated that one or more processes of the manufacturing line are performed by a human. Therefore, any combination of machine and human involvement may be implemented to achieve the formation of a shoe upper and potential completion of the shoe as a whole, in exemplary aspects.

Continuous in-line manufacturing allows for strategic implementation of engineered material properties, such as tensile strength, elongation characteristics, and moisture transportation in an efficient manner on a flat pattern. The flat pattern concept may provide for greater consistency of manufacturing and ability to implement less sophisticated machines and logic to perform portions of the manufacturing process relative to a dimensional upper manufacturing process.

Manufacturing System

FIG. 1 provide an overview of continuous in-line manufacturing of a shoe upper, in accordance with aspects hereof. FIG. 1, in particular, depicts a continuous in-line production system 100 on a substrate 101, in accordance with aspects hereof. The substrate 101, in an exemplary aspect, serves as a foundation on which flat uppers may be formed. The substrate 101, in an exemplary aspect, has minimal stretch that allows for a registration of position of materials applied thereon. For example, a system may track the location of the substrate 101 as it passes through the in-line manufacturing process. Knowledge of the substrate position may provide guidance of what and where processes should be performed on the substrate to generate a flat pattern upper portion, in an exemplary aspect. The substrate 101 may be of any width and/or of any length. In an exemplary aspect, the substrate 101 is a rolled good that has a width sufficient to form at least two, three, four, five, or six shoe upper flat patterns across the width. The substrate 101 has a width sufficient to form at least two flat pattern uppers in a common operation as a footwear flat pattern, as generally depicted in FIGS. 2-9. Each of the flat pattern uppers formed in a common footwear flat pattern are nested in a manner to limit surplus material, which may be waste or later recycled. This nesting is achieved, in an exemplary aspect, through the pattern used with a two-part medial side and footbed portion extending from a lateral side, as will be explained in detail hereinafter. Each of the footwear flat patterns formed in the continuous in-line operation may represent a different style, shape, configuration, or other deviation of shoe upper from the next footwear flat pattern.

The substrate 101 may be any material; however, in an exemplary aspect, the substrate 101 is a sheet material. For example, the substrate 101 may be a nonwoven fabric that is a sheet or web-like structure formed through entanglement of fibers/filaments by mechanical, thermal, and/or chemical processes. A nonwoven material may be a flat, porous material that is neither woven nor knit. A nonwoven material may be formed from recycled materials, such as scrap materials generated from the in-line manufacturing process itself.

A nonwoven may be a web material, such as an industrial felt, that is fabricated by a needle felting of polyester fibers. It is contemplated that the substrate 101, as a nonwoven or other material (e.g., woven/knit), may be formed from any synthetic or natural fibers. In an exemplary aspect, the fibers may be captured from the manufacturing process itself as part of a waste stream. For example, portions of the substrate 101 not forming an upper may be included in the waste stream following the formation of the shoe upper. The waste stream substrate 101 portions may be recycled to again form the substrate 101 for a subsequent manufacturing process, in an exemplary aspect. A nonwoven substrate 101 may provide greater economic efficiencies when contemplating recycling of waste stream materials relative to a knit or woven structure that have specific engineered structures (e.g., interlacing, looping) as opposed to random entanglement of fibers forming a nonwoven material, in an exemplary aspect.

The substrate 101 may alternatively be formed from a woven or knit material. For example, it is contemplated that the substrate 101 may be formed from an in-line knit or woven material such that the substrate begins as a yarn, fiber, thread or other raw material and is then formed into a sheet-like format as part of the in-line manufacturing process. Alternatively, it is contemplated that the substrate 101 is formed in a sheet-like format by knitting or weaving prior to being introduced with the in-line continuous manufacturing process.

Returning to FIG. 1 as it depicts the substrate 101 progressing along a series of manufacturing processing stations forming the continuous in-line manufacturing system. In particular, the system 100 is comprised of a conveyance system 102 and a series of processing stations 104, 106, 108, 110, and 112. The conveyance system 102 and the processing stations are exemplary in nature and merely intended to illustrate a continuous in-line manufacturing system. Similarly, while an exemplary footwear flat pattern is depicted in the substrate 101, alternative footwear flat patterns, such as those depicted in FIGS. 2-9, are contemplated. It is understood that different systems and stations may be implemented in any combination, spacing, sequence, and configuration to accomplish aspects provided herein. Exemplary processing stations may include, but are not limited to, printing station, liquid applying stations, heat stations, steam stations, cutting stations, punching stations, placing stations, sewing stations, adhesive stations, welding stations, vision stations, and the like. Further, it is contemplated that one or more stations may be combined into a common station that performs two or more operations in a common location and/or concurrently. Further, it is contemplated that one or more stations may be human occupied, such that the operation is performed by a human absent or in connection with a machine.

While the specific components and processes are depicted in connection with FIG. 1, it is understood that any processes (e.g., cutting, coupling, painting, printing, applying, forming, and the like) may be performed in any sequence in any number, in accordance with aspects hereof. Further, while specific components are depicted, it is contemplated that any combination, shape, ordering, material, and/or configuration of components may be implemented, in exemplary aspects.

Directional terms are used herein to provide relative positioning of one or more features. For example, toeward or toewardly describe a direction towards the toe end of a component/article. Similarly, heelward or heelwardly describes a direction toward the heel end of a component. Medial and lateral are directional terms relative to a formed dimensional shoe as worn by a user. For example, the medial side is toward an inner portion relative to a body midline of a user's foot when worn, and the lateral side is toward an outer portion relative to the body midline of the user's foot when worn.

FIGS. 2-9 depict a sequence of exemplary processes that may be performed by one or more stations of the system 100, in an exemplary aspect. However, the specific flat pattern upper formed from the system will vary from the illustrative example(s) provided herein. The flexibility of the system 100, by design, allows for the varied manufacturing of different flat uppers without material change to the system 100 configuration. Instead, it is contemplated that one or more stations may be activated or deactivated depending on a particular flat pattern upper passing there through. For example, it is contemplated that a first upper may utilize a printing station to add printed elements thereon while a subsequent upper formed on the same continuous substrate 101 does not utilize the printer station as the subsequent upper is of a different style. Similarly, it is contemplated that a first upper utilizes a station to perform a first task (e.g., particular cutting pattern, a particular stitching pattern, a particular adhering pattern, a particular printing pattern) while a subsequent upper of a different style/configuration also uses the processing station, but for a different task (e.g., a different particular cutting pattern, a different particular stitching pattern, a different particular adhering pattern, a different particular printing pattern).

Figure 2:
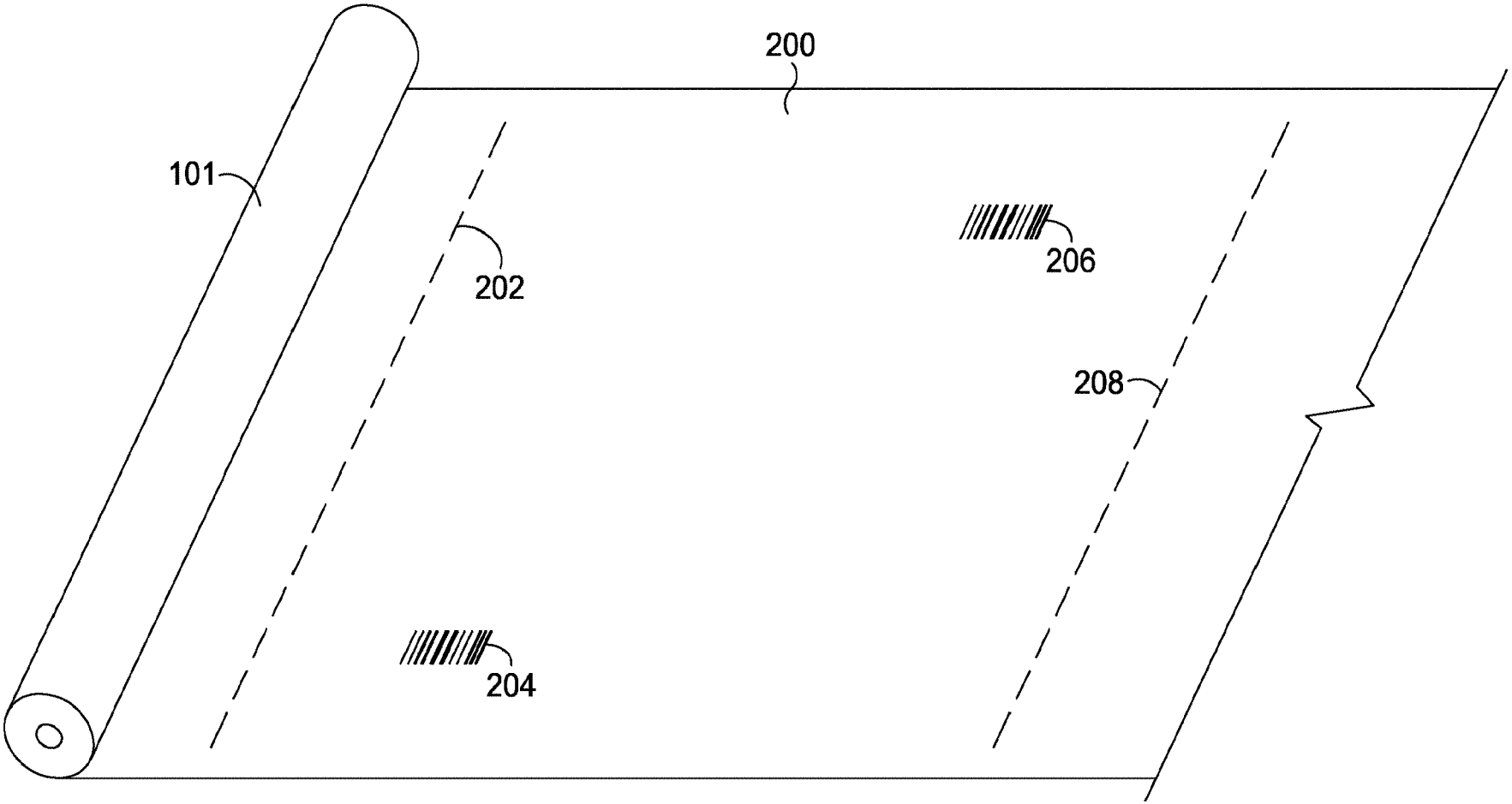
FIG. 2 depicts the substrate of FIG. 1 having identifiers thereon, in accordance with aspects hereof.

It is contemplated that one or more identifiers may be used to inform the system 100 of what operations should be performed for a given flat pattern upper. For example, it is contemplated that a vision recognition system may be used at one or more of the processing stations to identify a particular flat pattern upper based on the flat upper component, a marking (e.g., barcode, QR code), or other visually detectable feature. Exemplary identifier 204 and 206 are depicted in FIG. 2. It is also contemplated that a radio frequency identification technology may be implemented to identify a flat pattern upper at one or more of the processing stations. For example, it is contemplated that a radio frequency identification (RFID) technology may be leveraged. Other technologies are contemplated as well, such as embedded reactive fibers that react to one or more stimuli (e.g., electromagnetic energy). Additionally, it is contemplated that a position of a flat pattern on the substrate may be registered such that as the substrate 101 progresses to a known location/distance, a particular flat pattern upper formed thereon is also known. For example, positional identifiers may be formed/generated in connection with the substrate 101. Positional identifiers 202 and 208 are exemplary in nature and depicted in FIG. 2. It is further contemplated that two or more identification systems may be implemented in combination to assist in the manufacturing of uppers in a continuous in-line system.

Figure 10:
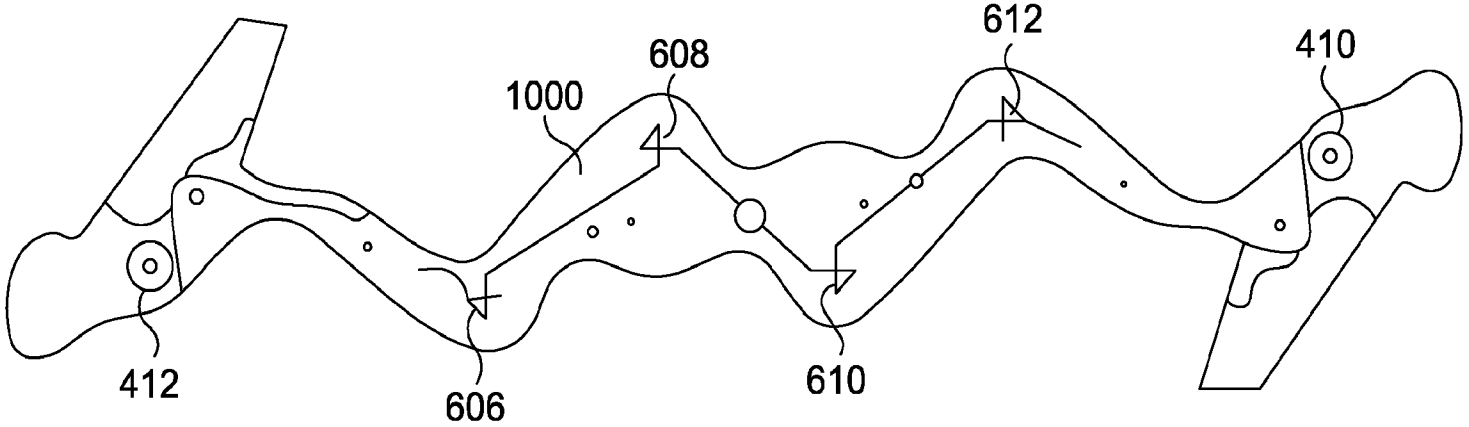
FIG. 10 depicts the surplus portion removed from the depiction in FIG. 8, in accordance with aspect hereof.

As depicted in FIG. 1, it is contemplated that the system 100 may progress until a flat pattern upper is removed from the continuous roll of substrate 101. As such, it is contemplated that a portion of the substrate 101 forms a portion of the removed upper. FIG. 1 depicts an extracted flat pattern upper outline 114 from the substrate 101. A remainder of waste stream is depicted by portion 116 of the substrate 101. The portion 116 may be recycled for use within another portion of a substrate for subsequent forming of an upper, in an exemplary aspect. As will be discussed hereinafter, a surplus portion 1000 as depicted in FIG. 10, may also contribute to the waste stream, where the surplus portion is formed from the nesting of two article of footwear in a common footwear flat pattern.

FIGS. 2-9 depict an exemplary sequence of forming a flat pattern upper 200, in accordance with aspects hereof. It should be noted that the flat pattern upper 200 may be part of a continuous substrate, such as a roll of nonwoven material depicted in FIG. 1. Therefore, while only a portion of the substrate 101 is depicted in FIGS. 2-9, it is contemplated as extending beyond the limits of the depicted elements in the figures. Additionally, as previously provided, the shape, size, and configuration of the components may deviate from the provided representations that are illustrative in nature. For example, it is contemplated that a footbed portion may be omitted or divided such that a portion is on a first medial side 804 and/or a second medial side 812 and another portion of the footbed portion may be on a lateral side 808, in an exemplary aspect. Further, it is contemplated in alternative aspects the flat pattern upper is formed without a continuous footbed portion. Therefore, alternative configurations, shapes, styles, and orientations of one or more features of the flat pattern upper are contemplated and not limited to the exemplary illustrations hereof.

Exemplary Sequence of Operations

FIGS. 2-9 and 11-12 depict exemplary steps performed for forming a dimensional shoe from a footwear flat pattern, in accordance with aspects hereof. It is understood that the specific configuration, order, and portions discussed and illustrated are exemplary in nature and not intended to be limiting. To the contrary, the discussion and illustrations provided herein are included to enhance the understanding of how concepts claimed and disclosed can be flexibly implemented while maintaining the spirit provided. Therefore, various article of footwear having varied structures, components, finishes, sizes, sidedness (e.g., left or right) may be formed with concepts provided herein.

FIG. 2 depicts the substrate 101 having the positional identifiers 202, 208 and the identifiers 204, 206 generated thereon, in accordance with an aspect hereof. The positional identifiers 202, 208 may be used by one or more operations to identify a location of the substrate for performing an operation. For example, the positional identifier 202 defines a first side along the longitudinal length of the substrate 101 for the footwear flat pattern 200 and the positional identifier 208 defines an opposite second side along the longitudinal length of the substrate 101 for the footwear flat pattern 200. The positional identifier 202, 208 may be generated by printing, such as with a marking substance visible in the visible wavelengths, UV wavelength, IR wavelengths, and the like. Additionally, the positional identifier 202, 208 may be marked with a machine-readable substance, such as a metallic material. Beyond printing, it is contemplated that an identifier may be generated through a deformation, such as forming an aperture, cutting, embossing, or otherwise manipulating one or more portions of the material (e.g., substrate) to generate the identifier.

The identifiers 204, 206 may be used for determining a position of one or more portions, but it is also contemplated that the identifiers 204, 206 may serve as a specific article identifier. For example, as previously introduced, a bar code, QR code, or other machine-readable technology may be implemented for the system to identify a particular article for performing article-specific operations. In this example, the identifier 204 is a bar code printed on what will be the ground-facing surface of a footbed portion. As such, the identifier 204 can be used through the forming of a dimensional shoe to maintain identification of the particular shoe until the ground-facing surface is obscured (e.g., application of a sole) or otherwise interfered with as an identifier. The position and type of identifier may be changed in exemplary aspects from that which is depicted for identifiers 204, 206.

Figure 3:
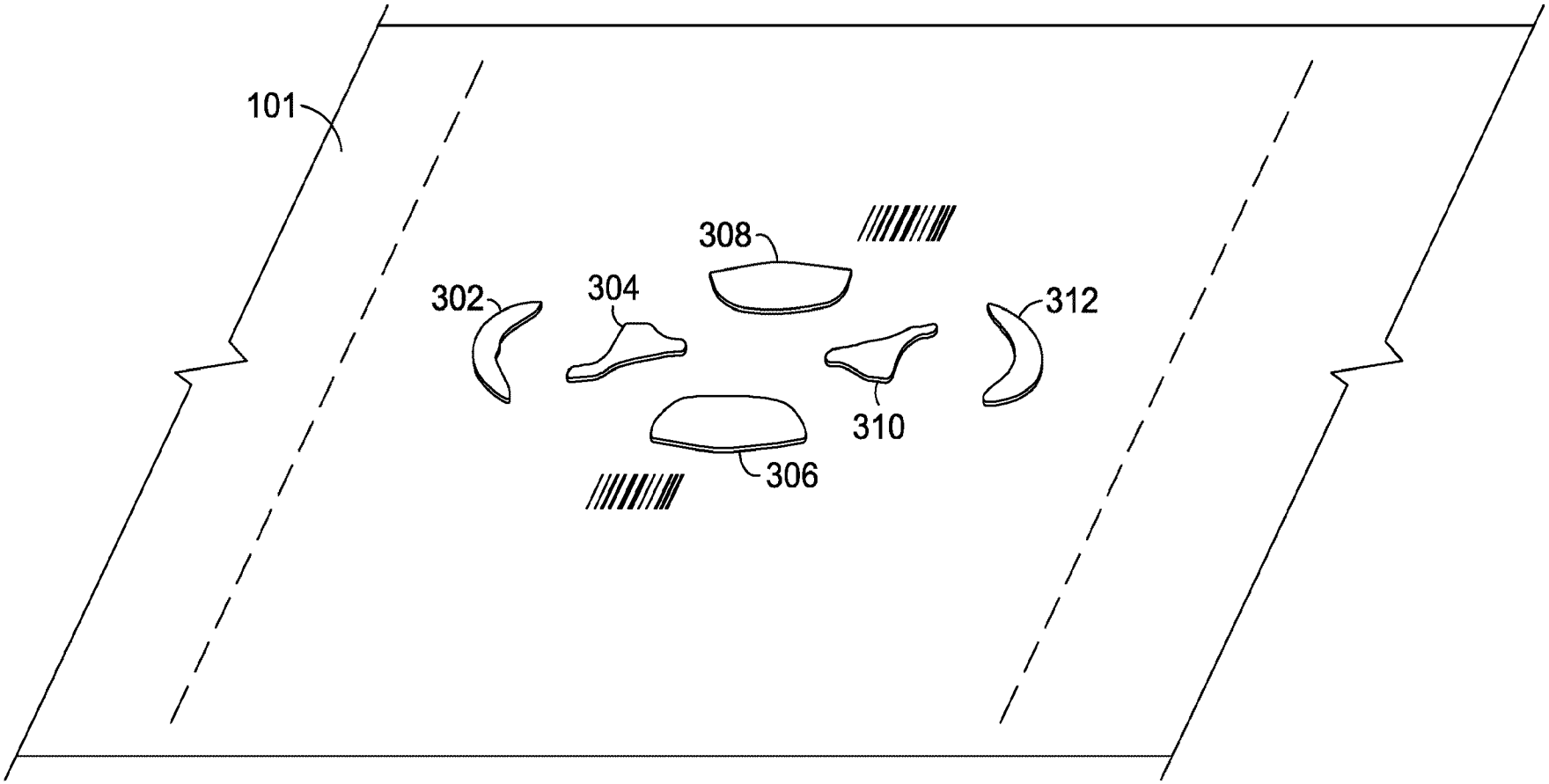
FIG. 3 depicts the substrate of FIG. 2 having structural materials placed thereon, in accordance with aspects hereof.

FIG. 3 depicts a structural material 302, 304, 306, 308, 310, 312 applied to the substrate 101, in accordance with aspects hereof. While optional in nature, the structural material may alter functional characteristics of the materials to which it is applied. For example, it is contemplated that the structural material provide abrasion resistance, rigidity, puncture resisting, and/or dimension to one or more areas of an article. For example, the structural material 302 may help provide structure to a toe end of a first article that is nested with a second article having the structural material 312 providing structure in a toe end of the later, in an exemplary aspect. Similarly, the structural material 304, 310 may provide structural integrity to an eye stay region of the first article and second article, respectively. The structural material 306, 308 may provide rigidity to a heel end of the first article and the second article, respectively. As can be appreciated, a structural material may be applied in any formation, quantity, and/or location. Further, it is contemplated that structural material may be applied to any material, such as the substrate or one or more overlays (as discussed hereinafter).

Structural materials may be applied by any means. For example, the structural material, which may be in liquid form, powder form, sheet form, or dimensional elements, may be applied by machine or human. In an exemplary aspect, the dimensional material may be applied by jetting, spraying, deposition, printing, placing, and the like. The structural material may be heat activated, UV activated, IR activated, or otherwise activated to change from an applied state (e.g., powder, fluid, malleable) to a second state (e.g., bonded, rigid, resistant to deformation). Alternative activation is contemplated as well (e.g., during a subsequent dimensional shoe forming process that also sets/cures the structural material).

Figure 4:
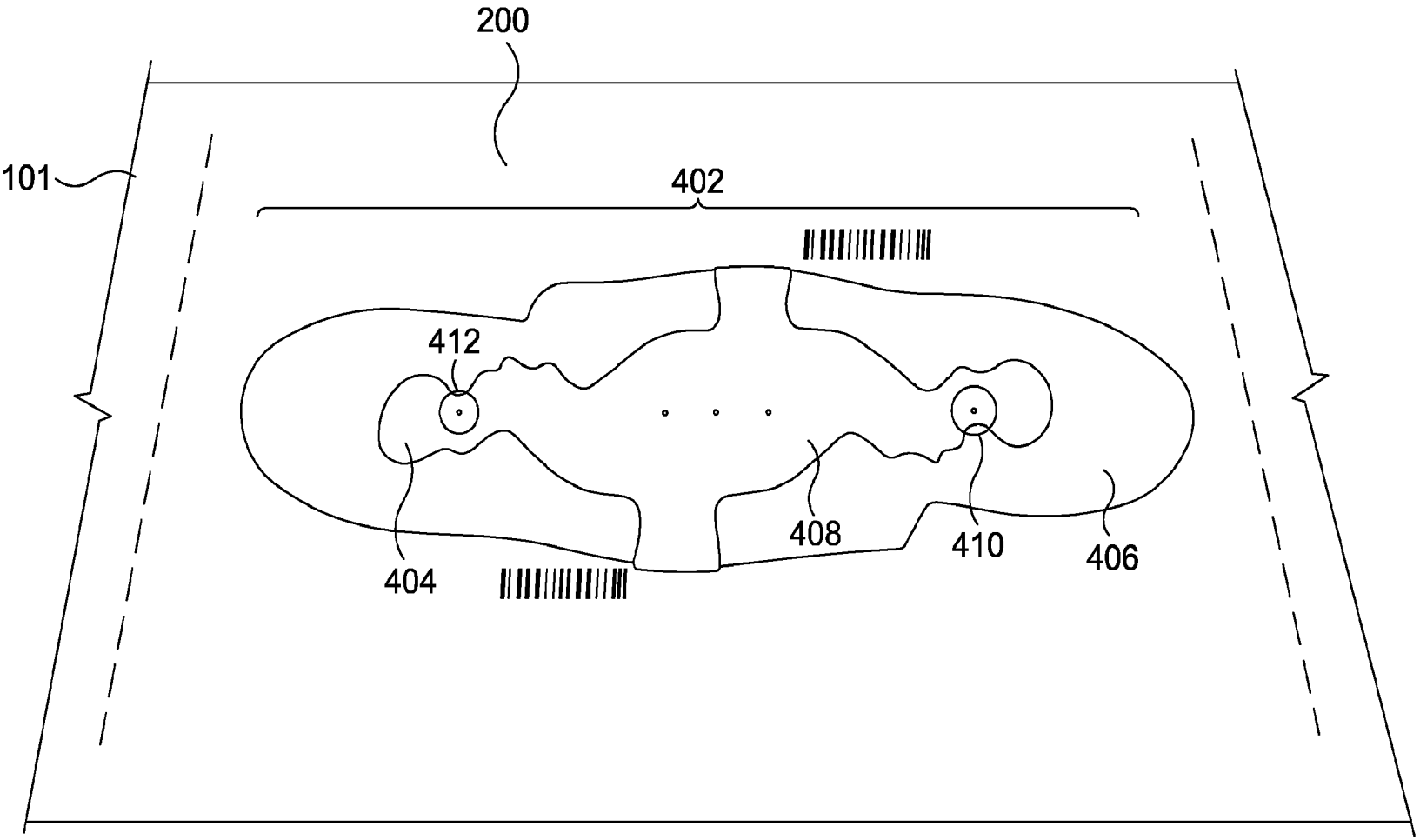
FIG. 4 depicts the substrate of FIG. 3 having an overlay placed thereon, in accordance with aspects hereof.

FIG. 4 depicts an overlay 402 applied to the substrate 101, in accordance with aspects hereof. The overlay 400, in this example, provides elements to nested articles forming the footwear flat pattern 200. Stated differently, the overlay 402 provides components, some of which are integrally continuous with each other, that form portions of two different articles that are nested together in the footwear flat pattern 200. In this example as will be evident in subsequent figures, the first and second articles of the footwear flat pattern 200 are both left sided shoes. The orientation and pattern used for each of the articles allows for a nesting with reduces surplus portions extending between the two articles. As such, a reduction in waste, time, energy, and other resources may be achieved with the various materials, such as those forming the overlay 402.

The term "continuous" as used herein denotes a portion that is contiguous with another portion in an integral manner. For example, an upper portion 801 is formed from a common contiguous material (e.g., the substrate 101 of FIG. 1) as the footbed portion 802 of a first article 800, all depicted in FIG. 8. A material forming each of the continuous portions (e.g., substrate 101) is integral with one another such that the portions converge together and are not subsequently joined together by welding, adhering, or stitching, for example. When additional materials, such as an overlay or structural material is also present in at least a first region, the first region is still continuous with a second region if the additional material is not continuous with the second region while the underlying substrate is continuous. Stated differently, not all materials in a first region must be continuous, uninterrupted material extending to the second region in order for the first and second regions to be continuous.

The overlay 402 may be a sub-assembly compiled at a different processing location, station, and/or line. The overlay may be formed from a variety of materials, such as knit, woven, foam, polymer sheet, leather, and the like. Additionally, it is contemplated in an exemplary aspect; the overlay may be a print overlay in which the overlay is printed on the substrate as an ink or other deposition. As such, an overlay and structural material may blend conceptually in an exemplary aspect.

The overlay 402 helps to visually identify in this exemplary continuous-production sequence of figures portions of the footwear flat pattern 200. For example, a first article of footwear is generally identified by number 404, a surplus portion is generally identified by number 408, and a second article of footwear is general identified by a number 406. Further, a first origin 412 is depicted in the first article of footwear 404 and a second origin 410 is depicted in the second article of footwear 406.

As provided, the first article of footwear 404 is nested with the second article of footwear 406. A subsequent removal operation will be effective to separate the first article of footwear 404, the second article of footwear 406, and the surplus portion 408 from each other and/or the substrate 101 on which they are formed. The removal operation may be a die cutting, CNC cutting, laser cutting, or other operations effective to separate one or more portions.

The first origin 412 and/or the second origin 410 provide a location from which process and/or components may be oriented to ensure appropriate positioning and/or alignment. For example, an overlay is positioned on the substrate material based on the location of one or more origins. The position of the overlay is determined based, in an exemplary aspect, on physical registration of an origin with an alignment aperture of the overlay. A combination of two or more origin apertures may be used in connection to provide both positional and rotational alignment between two or more components/layers. Further, it is contemplated that an origin provides positional guidance for one or more processes to be performed. For example, through mechanical interaction with an origin and/or optical detection of the origin, a robotic member may perform a process contemplated herein (e.g., cutting, sewing, gluing, welding, positioning) on one or more parts of the footwear flat pattern 200. In an exemplary aspect depicted in FIG. 6, an ankle collar overlay 502 is secured with CNC stitching to the overlay 402 and substrate 101. The stitching pattern is aligned with the overlays and substrate based on the first origin 412 and the second origin 410, in the example of FIG. 6.

An origin is positioned on the substrate in a throat portion, which extends between eye stays. A tongue of a shoe typically occupies the throat region of a shoe. Therefore, an origin is located in the pattern at a location that is associated with the location of a tongue, the shoe throat. The origin is therefore positioned between the lateral and medial side (first medial side 804 as discussed in FIG. 8) and positioned heelward of the toe end, but toeward of an ankle opening. Positioning of an origin in this location of the throat allows for the origin to be used during the formation process and to be removed as part of the surplus portion so as to not affect aesthetic or functional aspects of the shoe.

It is contemplated that the origin(s), while depicted as circular holes extending through the substrate, may instead be any shape or configuration. For example, an origin may be a visual marking through which an alignment pin extends. The extension of the alignment pin through the substrate may, at least temporarily, form an aperture. Alternatively, a visual alignment based on the location of an origin formed as a visual marker is contemplated. Also, it is contemplated that any number of origins may be utilized in any configuration and in any location to achieve aspects contemplated herein.

As will be depicted in subsequent figures, the nesting of common-sided shoes (e.g., two right shoes, two left shoes) having a pattern allowing for integrally continuous first medial side with the toe end, the toe end with the lateral side, the lateral side with the heel end, the heel end with the second medial side allows for a minimal common surplus region in which an origin may be formed for the first article of footwear and the second article of footwear. As such, a common removal operation is effective to remove both origins while limiting waste/surplus from previously common materials between the two articles (e.g., overlays positioned a single time for two articles), in this example.

The overlay 402 may be place on the substrate 101 based on the positional identifiers in an exemplary aspect. For example a vision system may determine a location of the footwear flat pattern 200 allowing for the appropriate positioning of the overlay 402 thereon. Additionally or alternatively, the first origin 412 and/or the second origin 410 may be visually or physically detected in the substrate 101 and used as an alignment aid for the positioning of the overlay 402.

Figure 5:
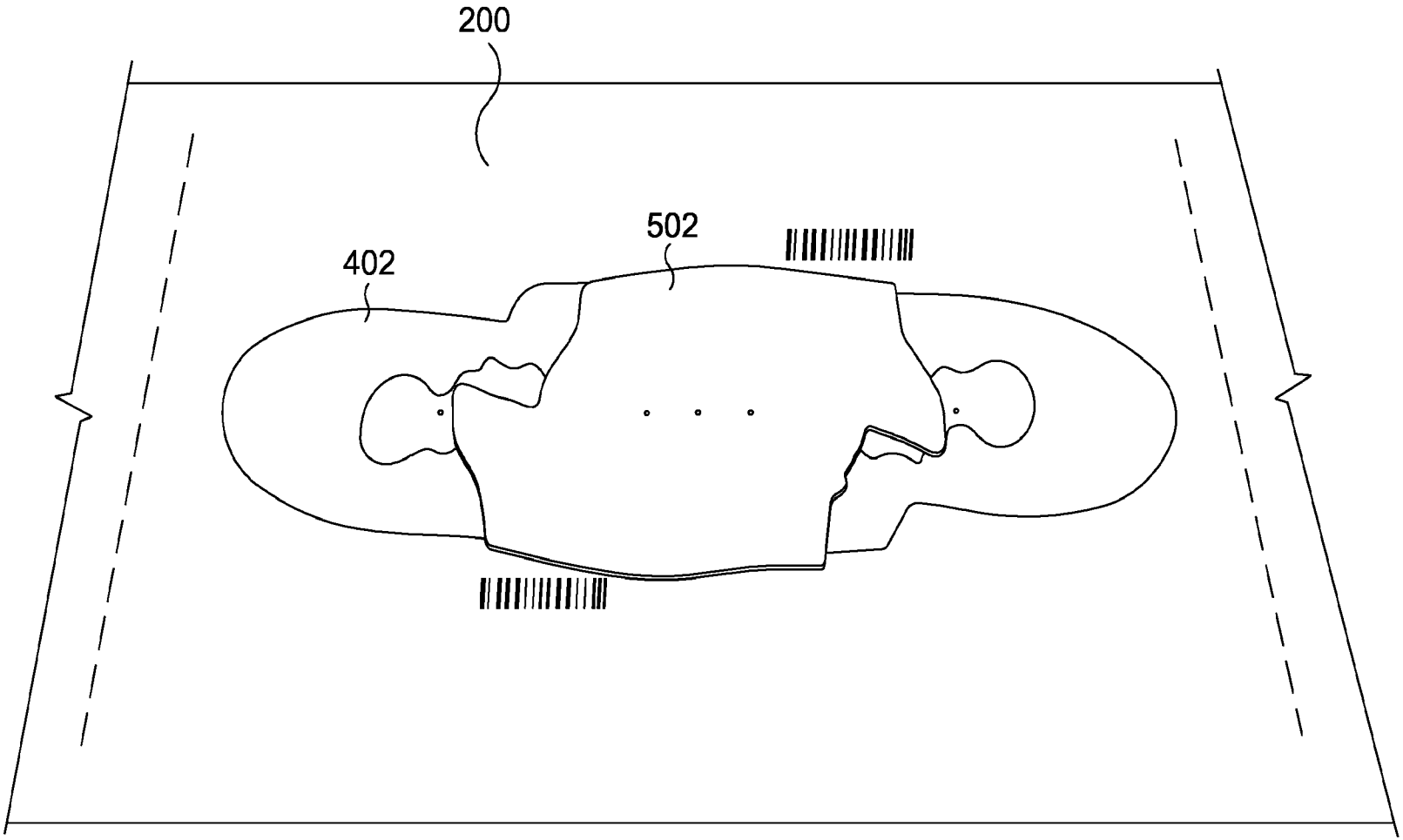
FIG. 5 depicts the substrate of FIG. 4 having an ankle collar overlay placed thereon, in accordance with aspects hereof.

FIG. 5 depicts the ankle collar overlay 502 positioned on the overlay 402. The ankle collar overlay 502 is positioned across portions of the first article and the second article. Additionally, the ankle collar overlay 502 extends across at least a portion of the surplus region. As such, a common overlay, such as the ankle collar overlay 502, may be positioned to serve nested articles simultaneously. The positioning of the ankle collar overlay 502 may be determined based on one or more origins or positional identifiers. Once positioned, an overlay, such as the ankle collar overlay 502, may be temporarily positioned such as with an ultrasonic weld, adhesive bond, stitch, or other fastening system. This temporary coupling of the overlay may be performed in the surplus region to limit impact on final articles.

Figure 6:
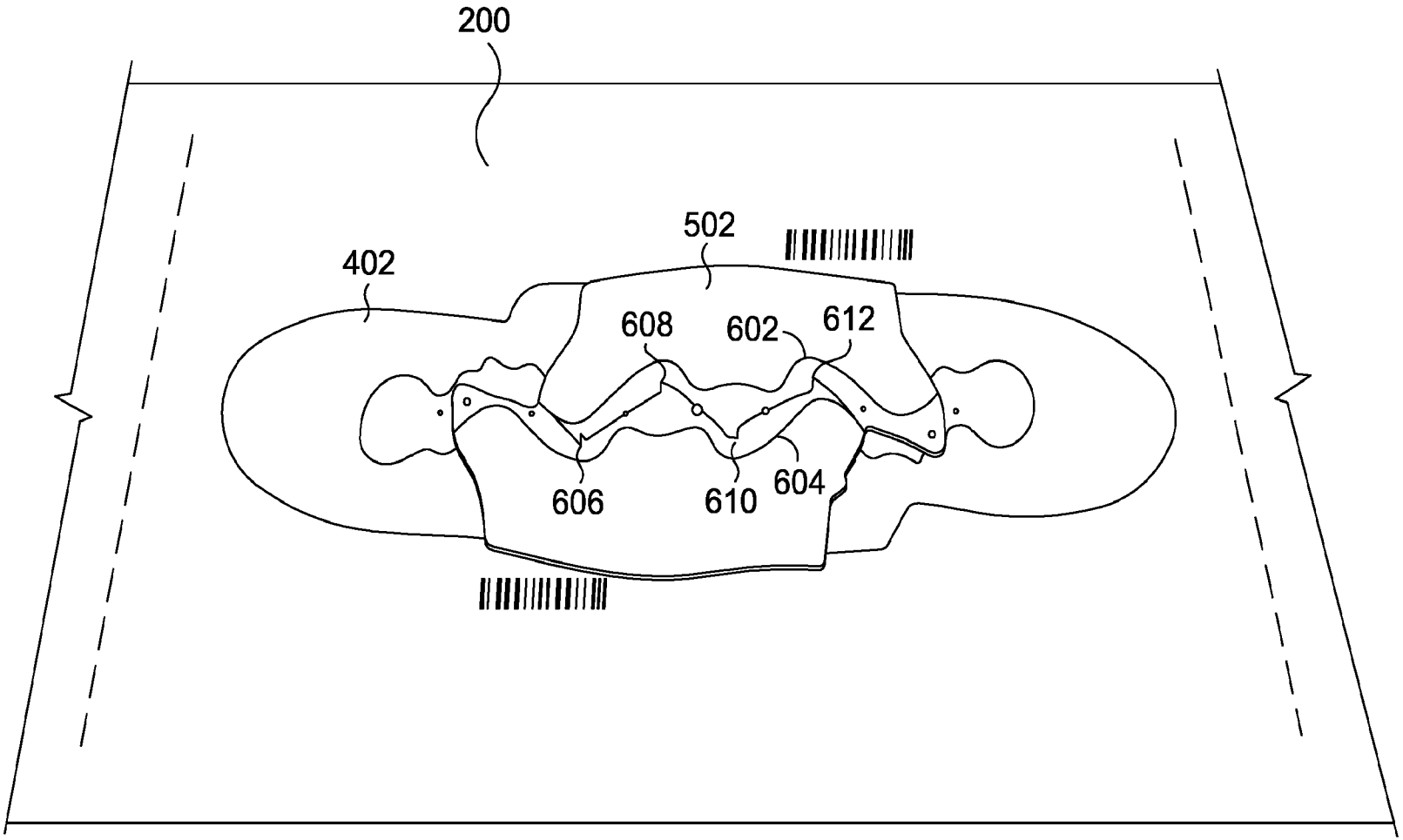
FIG. 6 depicts the substrate of FIG. 5 having overlays secured with stitching to the substrate, in accordance with aspects hereof.

FIG. 6 depicts the ankle collar overlay 502 secured to the footwear flat pattern 200. As depicted, the ankle collar overlay 502 is stitched to the footwear flat pattern 200. However, alternative or additional methods are contemplated, such as adhesive bonding, welding, and the like. A second stitch line 602 is depicted as forming a bond between the overlays and the substrate 101 along an ankle collar and at least a portion of a throat of the second article. Similarly, a first stitch line 604 is depicted forming an ankle collar and at least a portion of a throat for the first article. The positioning of the stitching may be controlled based on one or more origins. For example, it is contemplated that a digital line is computed as extending between the first origin and the second origin. The digital line is used as an alignment tool for a CNC sewing machine to align a sewing head for performing a programmed sewing sequence. Therefore, it is contemplated that a manufacturing operation (e.g., sewing) for a first article is determined based on an origin associated with the first article and a second article. Stated differently, a common operation for two article (e.g., a continuous sewing operation) is aligned and performed based on a positional identifier (e.g., an origin) associated with the first article and based on a positional identifier associated with the second article. This is different from performing an operation on a single article based on a positional identifier associated with that article as advantages of nesting and combined operations may not be realized in the single article example.

Also depicted in FIG. 6 are optional alignment process indicators 606, 608, 610, 612. In the specific example of FIG. 6, the alignment process indicators 606, 608, 610, 612 are stitched "X" markings. As the alignment process indicators 606, 608, 610, 612 are formed from a programmed operation that contemporaneously formed the first stitch line 604 and/or the second stitch line 602, the position of the respective stitch lines are known relative to each of the alignment process indicators 606, 608, 610, 612. Therefore, if a high level of accuracy (e.g., low tolerance) is desired for a subsequent operation (e.g., a cutting operation) relative to the first stitch line 604 and/or the second stitch line 602, the alignment process indicators 606, 608, 610, 612 may be used for alignment as opposed to alternative positional indicators (e.g. origins associated with the substrate 101, or one or more overlays). In practice, the forming of an ankle collar and/or throat with a turned seam uses a low tolerance to have a satisfactory finished good. Therefore, less than a millimeter (or less than half of a millimeter) deviation from a stitch line and a cut can result in a satisfactory or unsatisfactory finished shoe. As a result, relying on an origin that extends through multiple layers that may shift between operations or that is physically separated by sufficient distance to introduce error may not be provide useable tolerance control in an exemplary aspect. As such, in this example, the alignment process indicators 606, 608, 610, 612 are included in the stitching operation to form a positional identifier for a subsequent operation that is dependent on the position of the stitching operation. A vision system (e.g., camera and computer) may be implemented to identify one or more identifiers, such as the alignment process indicators 606, 608, 610, 612 for controlling one or more operations (e.g., placement of a cutting tool relative to a known location of a stitch from the alignment process indicators 606, 608, 610, 612).

Figure 7:
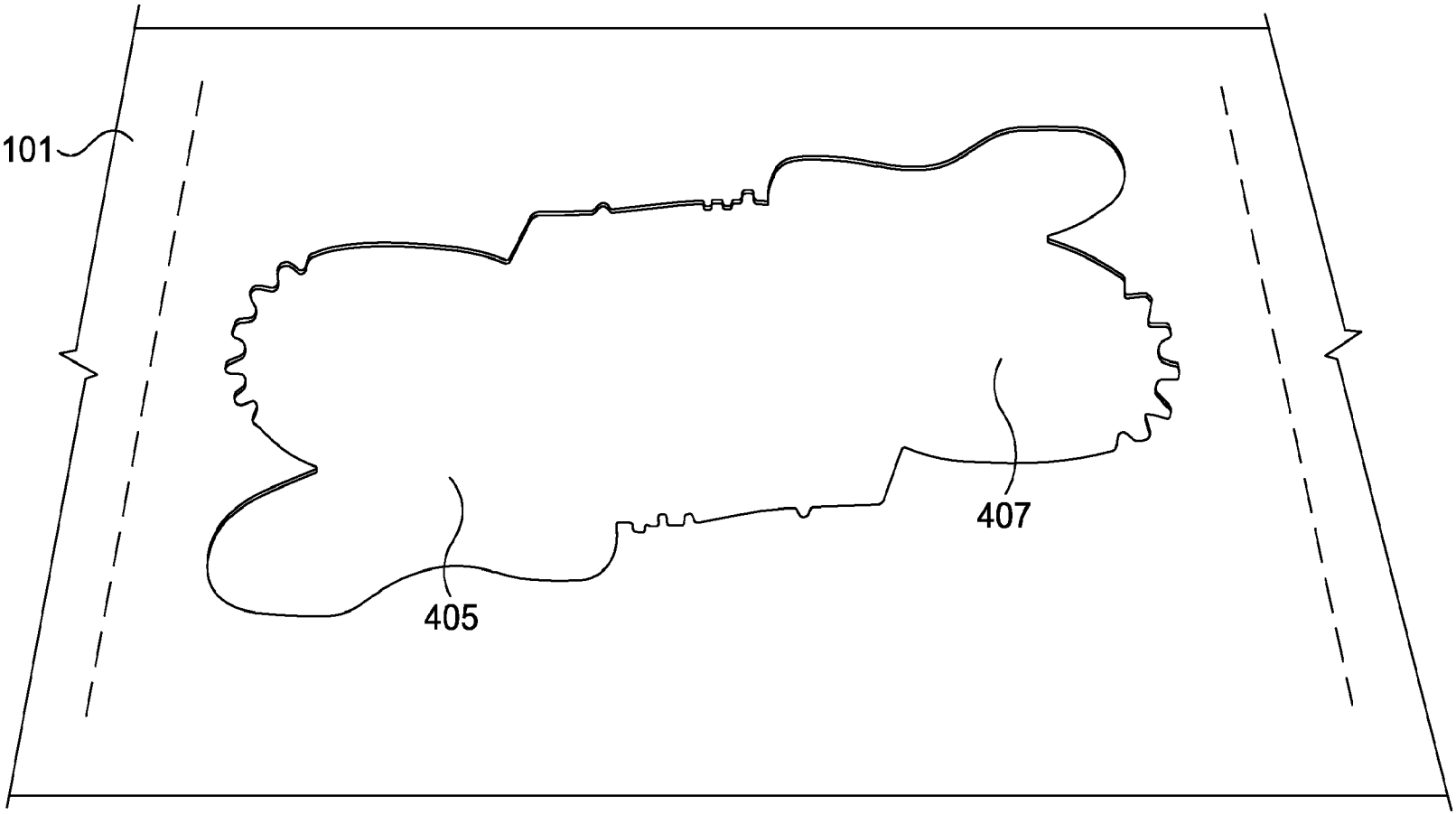
FIG. 7 depicts the footwear flat pattern removed from the substrate of FIG. 6, in accordance with aspects hereof.

FIG. 7 depicts the substrate 101 having the footwear flat pattern removed, in accordance with aspects hereof. The removal of the footwear flat pattern results in a void generally depicted by a first article void 405 and a second article void 407. The first article, the second article, and the surplus portion may be removed in a common operation from the substrate 101, or the first article, the second article, and/or the surplus portion may be removed separately from the substrate 101, in exemplary aspects. The removal may be performed by a cutting tool, such as a knife, laser, jet, hot knife, saw, die, and the like. Additionally it is contemplated that a pickup tool may be used to pick the separated part(s), in exemplary aspect. The remaining portions of the substrate 101 after a removal operation may be recycled or otherwise discarded as discussed herein above.

Figure 8:
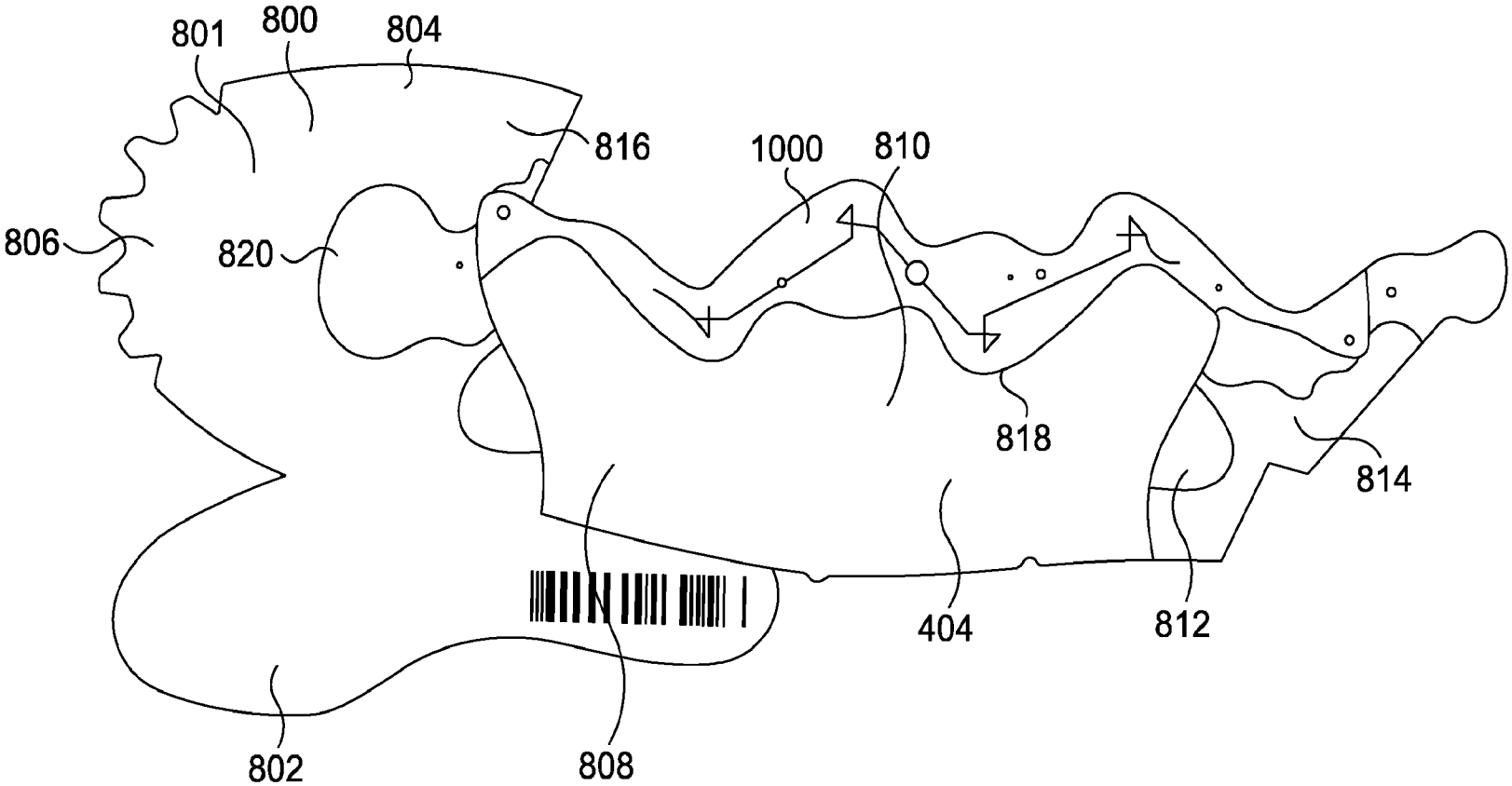
FIG. 8 depicts the first article of footwear and the surplus portion as removed from the substrate of FIG. 6, in accordance with aspects hereof.

FIG. 8 depicts the first article 800 and the surplus portion 1000 after being removed from the continuous roll of the substrate 101, in accordance with aspects hereof. The second article has been separated from the first article 800 and the surplus portion 1000 for illustrative purposes. The first article 800 is comprised of an upper portion 801 having a toe end 806, a lateral side 808, a heel end 810, a second medial side 812, and a first medial side 804. The first medial side 804 has a first edge 816 that is better depicted in FIG. 9 having the surplus portion 1000 removed. The second medial side 812 has a second edge 814 that is also better depicted in FIG. 9 hereinafter. Additionally, an eye stay 820 is depicted. Further, an ankle opening 818 is formed from a cutting operation adjacent the first stitch line 604, as seen also in FIG. 9. The first article is also comprised of an integrally continuous footbed portion 802. While not specifically numbered herein, the second article is also comprised of similarly positioned portions/areas.

With respect to the nesting depicted herein, it is contemplated that the first article toe end is positioned in an opposite orientation to a toe end of the second article. Stated differently, the first article toe end is positioned more proximate a first side of the footwear flat pattern than the second article, and the second article toe end is positioned more proximate a second side of the footwear flat pattern than the first article.

Figure 9:
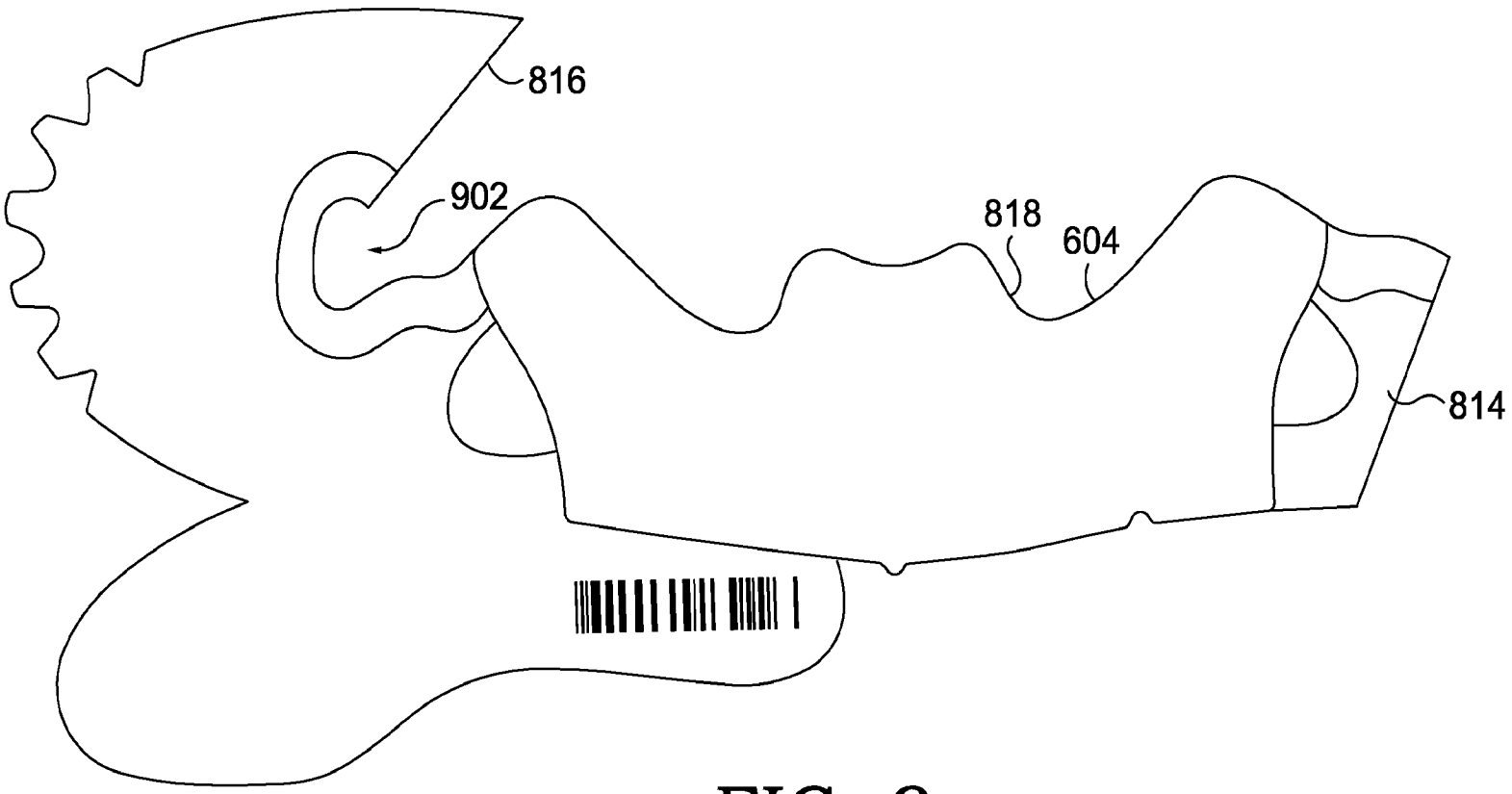
FIG. 9 depicts the first article of footwear from FIG. 8 with the surplus portion removed, in accordance with aspects hereof.

FIG. 9 depicts the first article having the ankle opening 818 adjacent the first stitch line 604 in preparation for a turn seam, in an exemplary aspect. Further, a throat 902 is depicted as extending between the eye stay. The throat 902 and the ankle opening were formed, in this example, through removal of the surplus portion 1000, as depicted in FIG. 10 hereinafter. The first edge 816 and the second edge 814 are depicted. As will be seen the first edge 816 and the second edge 814 will be joined together to form a dimensional shoe from the planar orientation currently depicted.

FIG. 10 depicts the surplus portion 1000 as removed, in accordance with aspects hereof. The first origin 412 and the second origin 410 have been removed from the previously nested first article and the second articles with the removal of the surplus portion 1000. Additionally, the alignment process indicators 606, 608, 610, 612 that may optionally be used to guide the cutting operation of the surplus portion 1000 from the first article and the second article have also been removed from the first and second articles. As such, the nesting allowed for a minimization of surplus material while allowing for manufacturing elements (e.g., positional identifiers) to be removed from the dimensional shoe(s).

Figure 11:
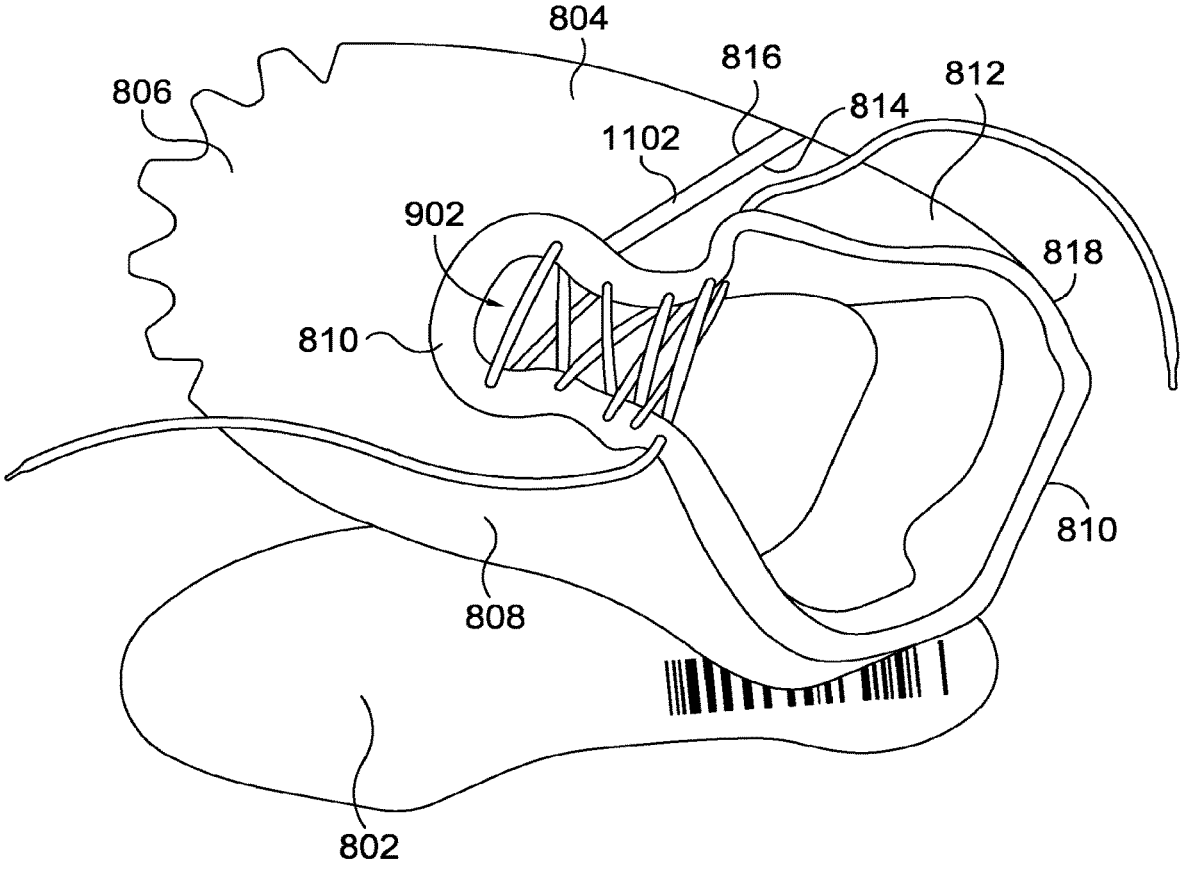
FIG. 11 depicts the first medial side and the second medial side of the first article of footwear joined, in accordance with aspects hereof.

FIG. 11 depicts the first article having the first edge 816 joined with the second edge 814 forming a seam 1102 extending from the eye stay 820 towards a location of the medial side to which the footbed portion 802 will be coupled (e.g., a bottom edge), in accordance with aspects hereof. Also depicted is a tongue portion at the throat 902. The tongue may be formed in a sub-assembly manner and joined with the first article prior to forming the seam 1102 or subsequent to forming the seam 1102. The seam 1102 is depicted as a stitched seam; however, it is contemplated that any joining technique may be implemented. For example, an adhesive bond, weld, or other joining mechanism may be used. Also depicted is the ankle collar overlay rolled over the first stitch line forming the ankle opening 818. The ankle collar overlay extends from the exterior of the article to an internal surface providing a comfortable surface for interaction with a wearer's body.

Figure 12:
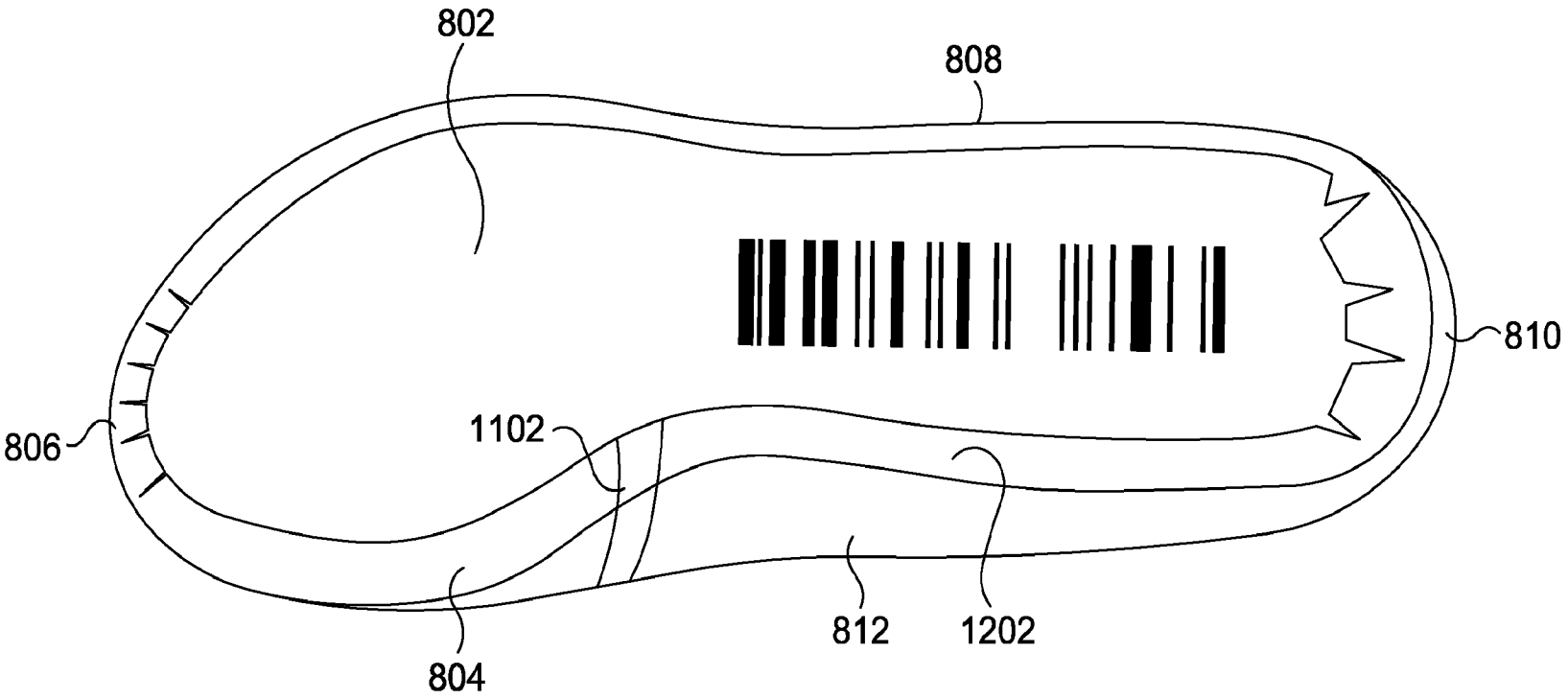
FIG. 12 depicts the ground-facing surface of the footbed portion once coupled with the upper portion of the first article of footwear from FIG. 11, in accordance with aspects hereof.

FIG. 12 depicts a ground-facing surface of footbed portion 802 forming a dimensional shoe while in a lasted configuration, in accordance with aspects hereof. The first article shows the footbed portion continuously extending from the lateral side 808 and coupled with the toe end 806, the first medial side 804 on a first side of the seam 1102 and the second medial side 812 on the second side of the seam 1102. The footbed portion 802 is further coupled with the heel end 810. Insertion of a last into the internal volume of the shoe in FIG. 12 prior to coupling the footbed portion 802 allows for the upper portion to form to the contours defined by the last once the footbed portion is coupled to the upper portion.

Figure 13:
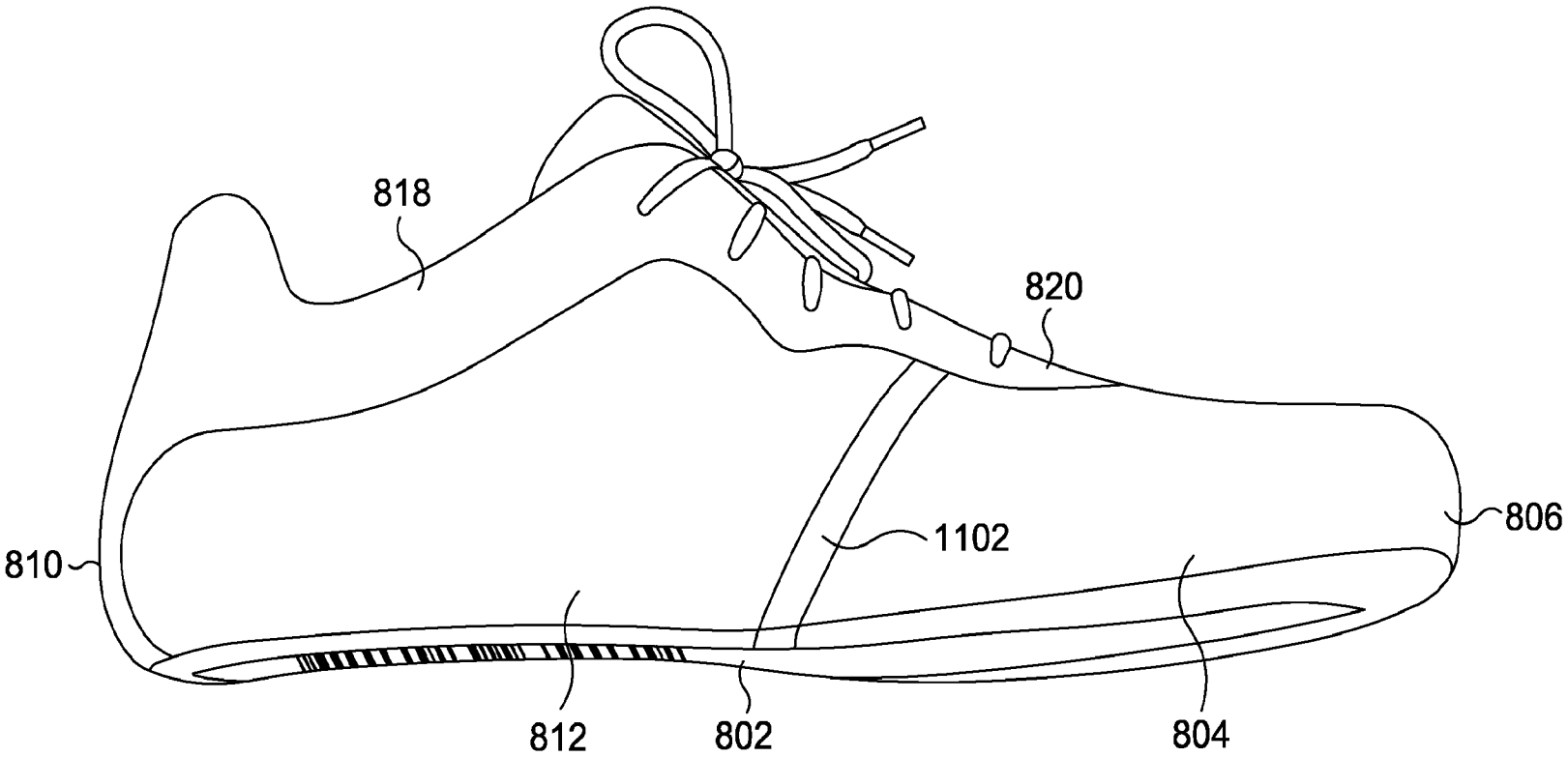
FIG. 13 depicts a medial view of the article of footwear formed in FIGS. 2-9 and 11-12, in accordance with aspects hereof.

FIG. 13 depicts a medial view of the lasted upper, in accordance with aspects hereof. A sole structure may be coupled with the lasted upper to form a completed shoe. Alternatively, it is contemplated that one or more additional processes may be performed to prepare the footbed portion 802 to serve as a ground-contacting service, in an exemplary aspect.

The seam 1102 is on the medial side, in an exemplary aspect, because the convex nature of the lateral side is more effective for the continuous footbed portion to extend from, in an exemplary aspect. As such, the concave nature of the medial side allows for shaping of the upper around a last as the footbed portion is coupled to the non-continuous portions of the upper. Having a seam on the lateral side joining discrete portion of the lateral side interferes with the continuous nature of the footbed portion 802, in an exemplary aspect. However, it is contemplated in exemplary aspects that the footbed portion may extend from the medial side in a continuous manner. Further, it is contemplated that a joining seam may alternatively or additional extend along any portion of the article, such as the later side, the heel end, and/or the toe end. As such, multiple configurations are contemplated herein.

Figure 14:
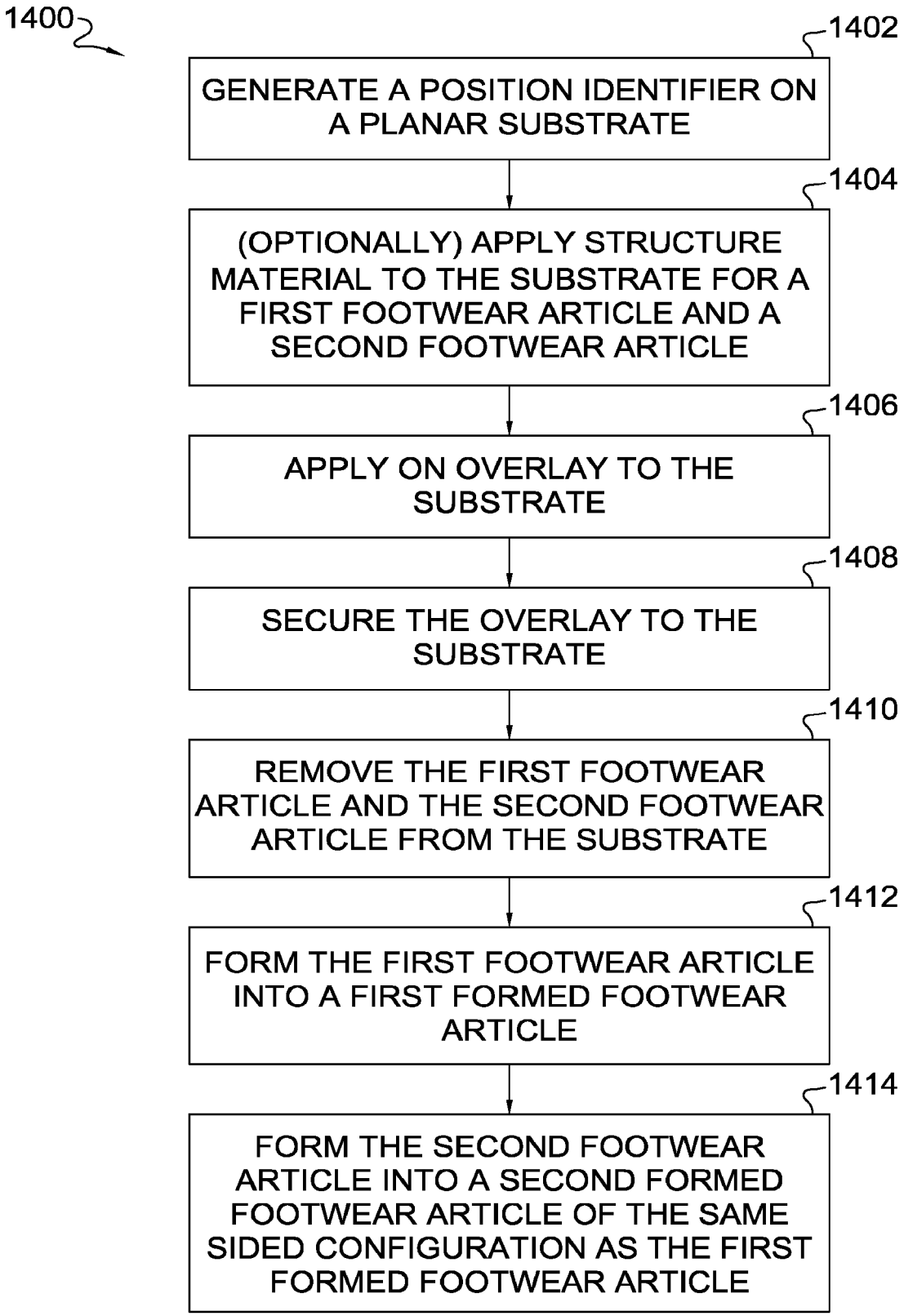
FIG. 14 depicts a flow diagram representing a method of manufacturing same-sided articles of footwear from a nested pattern configuration, in accordance with aspects hereof.

FIG. 14 illustrates a diagram 1400 depicting a method of forming a two shoes from a nested planar configuration, in accordance with aspects hereof. At a block 1402, a position identifier is generated on a planar substrate. For example, as discussed with FIG. 2, the position identifier may be a visual marking and/or a deformation of the. Example of a position identifier includes the positional identifiers 202, 208 of FIG. 2. Additional examples include apertures, pins, or other identifiable features.

At a block 1404, a structure material is applied to the first footwear article and a second footwear article on the substrate. The application of the structure material is optional, as are all steps of FIG. 14. As discussed with respect to FIG. 3, the structural material may be provided in a variety of forms (e.g., liquid, powder, polymer sheet) and in a variety of materials (e.g., thermoplastic polyurethane, activated hardeners, stiffening materials, silicone, adhesives). The structural material may provide tenacity, rigidity, dimensional, abrasion resistance, and the like to one or more portion of the article. For example, a structural material may be applied to help form the toe cap, the heel stay, an arch region, and/or an eye-stay reinforcement. Further, it is contemplated that the structural material is later formed into a desired shape. For example, in a subsequent molding operation the structural material may form to a desired configuration. An example may include forming the shoe upper about a last where an activator (e.g., thermal energy) is applied to shape the upper and mold the structural material simultaneously.

At a block 1406, an overlay is applied to the substrate. The overlay may be applied by a pickup tool guided by a vision system or other automated mechanisms. Both FIGS. 4 and 5 depict applying an overlay to the substrate. At a block 1408 the overlay is secured to the substrate, either directly or indirectly. FIG. 6 depicts an overlay (or plurality of overlays) being secured to the substrate. The securing may be performed by a sewing operation, welding operation, adhesive bonding operation, and the like. At a block 1410, the first footwear article and the second footwear article are removed from the substrate. The removal may be a cutting and picking operation. For example, a CNC cutting tool may cut the respective articles from the substrate and a pickup tool (e.g., vacuum powered, static powered, mechanical gripping) may move the cut articles.

At a block 1412, the first footwear article is formed into a first formed footwear article. For example, as depicted in FIGS. 11 and 12, a medial seem may be formed to take the article from a planar state to a dimensional state and a footbed portion may be secured to a bottom edge of the upper portion of the article. This may be performed in part about a last to define a shape of the article of footwear. At a block 1414, the second footwear article is formed into a second formed footwear article of the same sided configuration as the first formed footwear article. As both the first and the second footwear articles are of the same sidedness (e.g., both right-foot configuration, both left-foot configurations), an efficient nesting may be accomplished that minimizes waste from a surplus portion, in an exemplary aspect. The nesting of same-sided footwear articles is further enhanced with the continuous nature among the first medial side, the toe end, the lateral side, the heel end, and the second medial side with a division between the first medial side and the second medial side. However, alternative pattern configurations for sufficient nesting are contemplated and may be implemented in connection with aspects provided herein. As such, the concepts provided are not limited to the configuration discussed, but instead the configurations are illustrative of potential applications.

It will be understood that certain features and subcombinations are of utility and may be employed without reference to other features and subcombinations and are contemplated within the scope of the claims. Not all steps listed in the various figures need be carried out in the specific order described or carried out at all. Not all regions, areas, components, parts, and/or elements need to be arranged as illustrated or described. Alternatives are contemplated.

The invention claimed is:

1. A footwear flat pattern, comprising:

a first article of footwear pattern;

a second article of footwear pattern;

a surplus portion, the surplus portion extending between the first article of footwear pattern and the second article of footwear pattern, wherein the first article of footwear pattern, the second article of footwear pattern, and the surplus portion are integrally continuous; and an overlay secured to, and extending between, the first article of footwear pattern and the second article of footwear pattern, the overlay defining a shape that is distinct from the first article of footwear pattern and the second article of footwear pattern.

2. The footwear flat pattern of claim 1, wherein the footwear flat pattern is formed, at least in part, from a substrate, and wherein the substrate is continuous with one or more footwear flat patterns.

3. The footwear flat pattern of claim 2, wherein the substrate is a non-woven material.

4. The footwear flat pattern of claim 1, wherein the first article of footwear pattern and the second article of footwear pattern are both right-foot configurations.

5. The footwear flat pattern of claim 1, wherein the first article of footwear pattern and the second article of footwear pattern are both left-foot configurations.

6. The footwear flat pattern of claim 1, further comprising a first footbed portion having a toe end and an opposite heel end, a medial side and an opposite lateral side, wherein a first upper portion of the first article of footwear pattern and the first footbed portion are integrally continuous, such that a first upper portion lateral side converges with the first footbed lateral side.

7. The footwear flat pattern of claim 6, wherein the first footbed portion comprises an identifier.

8. The footwear flat pattern of claim 7, wherein the identifier is a visual identifier effective to identify at least the first article of footwear pattern.

9. The footwear flat pattern of claim 6, further comprising a second footbed portion having a toe end and an opposite heel end, a medial side and an opposite lateral side, wherein a second upper portion of the second article of footwear pattern and the second footbed portion are integrally continuous, such that a second upper portion lateral side converges with the second footbed lateral side.

10. The footwear flat pattern of claim 9, wherein the second footbed portion comprises of an identifier.

11. The footwear flat pattern of claim 9, wherein the footwear flat pattern is arranged with the first footbed portion proximate a first upper portion of the first article of footwear pattern, the first upper portion proximate the surplus portion, the surplus portion proximate the second upper portion, and the second upper portion proximate the second footbed portion.

12. The footwear flat pattern of claim 1, wherein a heel end of the first article of footwear pattern is positioned between a lateral side of the first article of footwear pattern and a medial side of the second article of footwear pattern.

13. The footwear flat pattern of claim 1, wherein a toe end of the first article of footwear pattern and a toe end of the second article of footwear pattern are oppositely oriented within the footwear flat pattern.

14. The footwear flat pattern of claim 1, wherein a toe end of the first article of footwear pattern is proximate a first side of the footwear flat pattern and a toe end of the second article of footwear pattern is proximate an opposite second side of the footwear flat pattern.

15. The footwear flat pattern of claim 1, wherein the surplus portion is comprised of a first origin and a second origin, the first origin positioned in a throat of the first article of footwear pattern, and the second origin is positioned in a throat of the second article of footwear pattern.

16. The footwear flat pattern of claim 15, wherein the surplus portion forms, at least in part, a throat portion of the first article of footwear pattern and a throat portion of the second article of footwear pattern.

17. The footwear flat pattern of claim 15, wherein the surplus portion defines, at least in part, a throat opening and an ankle opening in the first article of footwear pattern.

18. The footwear flat pattern of claim 17, wherein the surplus portion defines, at least in part, a throat opening and an ankle opening in the second article of footwear pattern.

19. The footwear flat pattern of claim 1, wherein the overlay extends from the first article of footwear pattern, across at least a portion of the surplus portion, and to the second article of footwear pattern, and wherein the overlay covers only part of the first article of footwear pattern and part of the second article of footwear pattern.

20. The footwear flat pattern of claim 1, wherein the overlay is integrally continuous at the first article of the footwear flat pattern and the second article of the footwear flat pattern.

* * * * *